United States Patent [19]

Hornbacher

[11] 4,139,248

[45] Feb. 13, 1979

[54] FILING SYSTEM FOR VERTICALLY SUSPENDING DOCUMENTS

[76] Inventor: Walter Hornbacher, 2001 Centre St., N., Calgary, Alberta, Canada

[21] Appl. No.: 790,821

[22] Filed: Apr. 25, 1977

[51] Int. Cl.[2] ..... A47B 63/00

[52] U.S. Cl. ..... 312/184; 312/201; 312/250; 211/125

[58] Field of Search ..... 312/184, 201, 250; 211/125, 51.1, 46, 59.1

[56] References Cited

U.S. PATENT DOCUMENTS

| | | | |
|---|---|---|---|
| 1,215,240 | 2/1917 | Becker | 312/201 |
| 3,312,513 | 4/1967 | Barker | 312/184 |
| 3,312,514 | 4/1967 | Barker | 312/184 |
| 3,312,515 | 4/1967 | Barker | 312/184 |
| 3,312,517 | 4/1967 | Barker | 312/184 |

FOREIGN PATENT DOCUMENTS

| | | | |
|---|---|---|---|
| 534,474 | 1/1955 | Belgium | 312/184 |
| 1,245,312 | 7/1967 | Fed. Rep. of Germany | 312/184 |

*Primary Examiner*—Victor N. Sakran

*Attorney, Agent, or Firm*—Larson, Taylor and Hinds

[57] ABSTRACT

Disclosed herein is a filing system for vertically suspending large documents. The filing system comprises in combination the filing cabinet and a strip attachable to the document and mountable within the filing cabinet. The filing cabinet in a preferred embodiment is comprised of a main frame mounted on four supporting casters, a pull-out unit having two casters mounted at one end and a bearing support assembly for telescopically mounting the other end of the pull-out unit to the base of the main frame, and a plurality of laterally spaced apart groups of horizontally extending cantilever bars with first ones of each group of bars being rigidly mounted to the top of the main frame and second ones of said bars of said groups being mounted at the top of the pull-out unit. The bars are substantially coplanar and conjointly support the documents. The elongate strip is of a thin, flexible polyester material and has a plurality of groups of coplanar oval orifices therein equal in number and spaced so as to be mountable on the plurality of bars.

8 Claims, 9 Drawing Figures

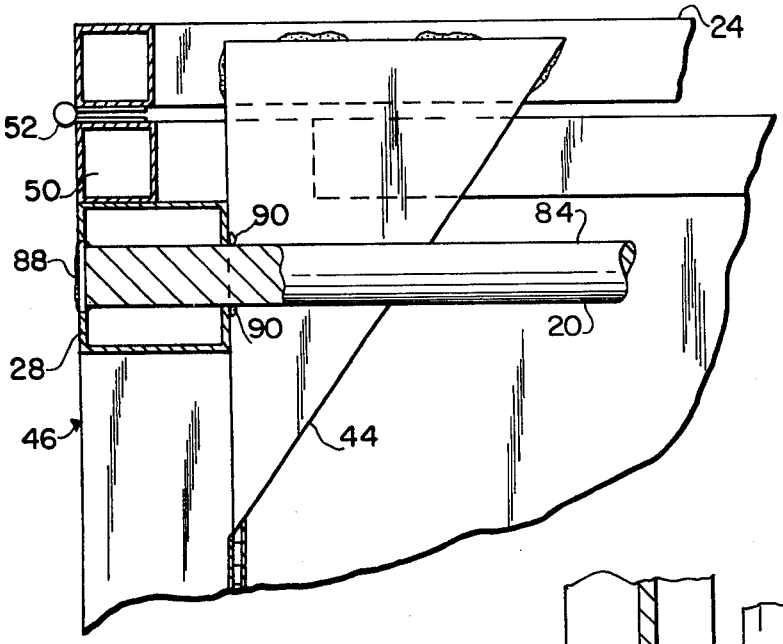
FIG. 7
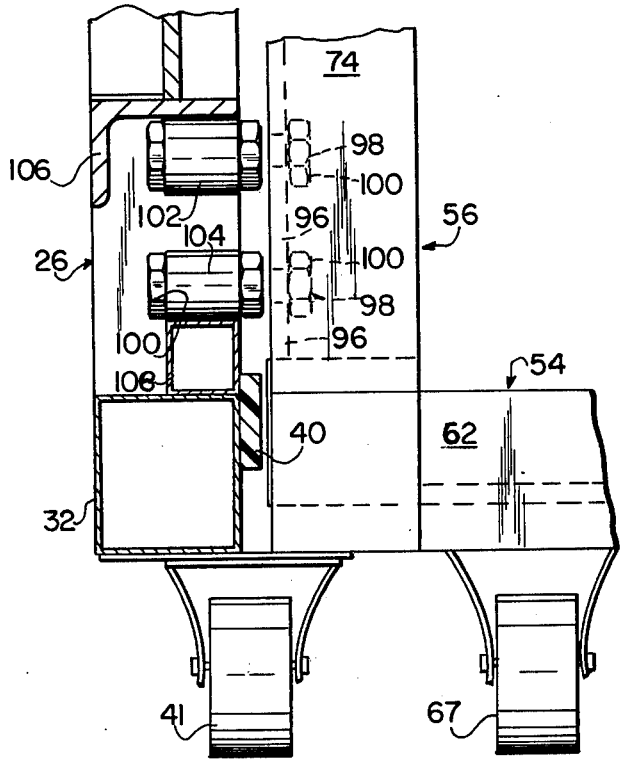
FIG. 8
FIG. 9
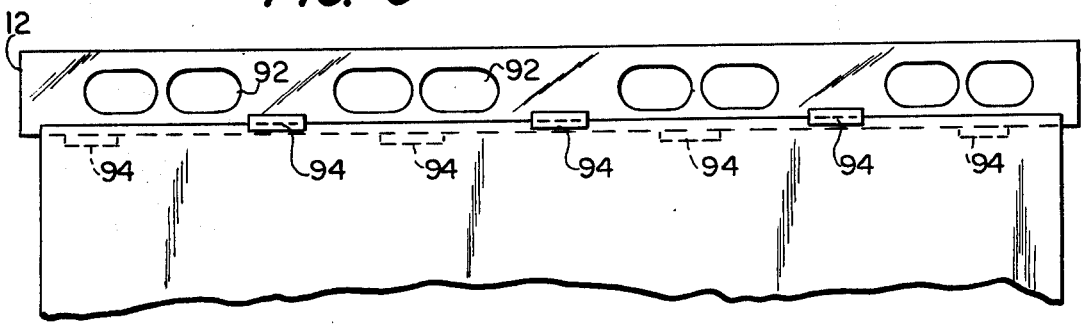

FILING SYSTEM FOR VERTICALLY SUSPENDING DOCUMENTS

FIELD OF THE INVENTION

The present invention relates to a filing system for vertically suspending large documents and more particularly relates to a filing cabinet and a mounting strip attachable to the documents and mountable on rods in the filing cabinet.

BACKGROUND OF THE INVENTION

The prior art is replete with filing cabinets for vertically hanging drawings and the like on opposed, horizontally extending pins which are attached to opposite supporting members in the filing cabinet. Many of the filing cabinets disclosed in the prior art utilize curved, or pivoting bar support arrangements. In practice, both of these arrangements are completely impractical and unusable with large quantities of drawings. As a result, large amounts of storage space is either wasted or the drawings are damaged when too many of them are stored in these types of filing systems. Naturally, if a large number of drawings must be safely stored, a large number or incompletely filled filing cabinets must be used with the large attendent increase in cost of the filing system. Many other conventional filing systems use a male and female mating bar assembly which also has tremendous practical difficulties. Drawings kept in male and female mating bar assemblies are difficult to separate and to extract a particular drawing. Additionally, it has been found that in a fully loaded cabinet of this type, the female bar tends to jam within its cooperating male bar and thus causes damage to the cabinet and renders it unusable. Filing cabinet systems of the foregoing type for suspending drawings, documents, sheets and the like are disclosed in the following references: Adams, U.S. Pat. No. 1,335,415 disclosing curved male and female supporting bars; Klitsche, U.S. Pat. No. 1,170,975 disclosing a pair of curved, interconnecting opposed supporting bars; Mobus, U.S. Pat. Nos. 2,205,903 and 2,711,941 disclosing male and female pivoted supporting bars; and Rubissow, U.S. Pat. No. 3,292,982 disclosing telescopic male and female supporting bars which are either straight or curved.

Other types of vertical filing systems disclose horizontal oppositely projecting supporting bars which are attached to relatively movable lathes or vertical dividers. These types of filing systems are disclosed in the Barnhart U.S. Pat. No. 1,416,661 and the Barker Canadian Pat. Nos. 832,899 and 832,900 through 832,902. These systems have at least two major disadvantages. Firstly, it is extremely difficult to view one of the suspended documents without removing it from the filing cabinet and secondly the maximum number of documents storable in this type of filing system is greatly reduced because of the internal dividers and lathes.

The prior art also discloses a plethora of means for hanging the documents from the supporting bars. For example, in the aforementioned Rubissow and Barker patents, the documents themselves are perforated with the resulting holes being reinforced. This system has the obvious disadvantages of permanently disfiguring the documents and relegating the documents for use in only one type of filing cabinet. Other filing systems use expensive and bulky clips which are rigidly attached to the documents. Two such clips are disclosed in the Dannheiser U.S. Pat. No. 923,412 and the aforementioned Adams patent. Still other conventional systems use sheet protectors which totally encompass the drawing or the upper part thereof, such as disclosed in the Amberg Canadian Pat. No. 504,088 or in the aforementioned Mobus patent. All of the foregoing suspension means are bulky, which reduce the number of storable documents, preclude the document from being universally storable, tend to catch on the supporting bars, and/or can damage the document if not carefully used.

SUMMARY OF THE INVENTION

An integrated filing system according to the present invention has advantageous features for overcoming the foregoing and other disadvantages. The present filing system can economically and efficiently store twice as many vertically hung documents as the prior art systems. A filing cabinet of the present system is of rugged and sturdy construction, yet has an overall small weight so that is is easily movable. When opened, documents can be easily viewed without removing them or can be easily removed without damaging the remaining documents. The present system overcomes the disadvantages of conventional systems which, when overloaded, did not permit easy access or removal of the stored documents and which usually resulted in the documents being torn or otherwise damaged.

The present invention also provides a means for vertically suspending the documents in a file cabinet which occupies very little additional space, is rugged, easily slides over and is removable from the document supporting bars, and is extremely lightweight. The attachment means does not result in a disfigurement or damage to the document and can be readily attached to or removed from the document and reused with another document. It is extremely inexpensive and can be easily stored in large numbers for future attachment and use with documents to be suspended in a filing cabinet.

A filing cabinet according to the present invention comprises a first frame having a first base and a first vertical side mounted at the bottom end thereof to one end of the first base. A second frame, having a second base and a second vertical side mounted at the bottom end thereof to one end of the second base, is slidably receivable by the first frame such that the other end of the second base is cooperatively engaged with the other end of the first base. As such, the first and second frames can be relatively separated to open the filing cabinet and can be relatively combined to close the filing cabinet. At least two, laterally spaced apart groups of horizontally extending cantilevered bars are provided with first ones of each group of bars being rigidly mounted to the top end portion of the first side and second ones of each group of bars being rigidly mounted to the top end portion of the second side. Documents are conjointly suspended from the bars at one end of the document.

A means for suspending documents comprises an elongate strip attachable along the bottom thereof to the document. The strip has therein a plurality of spaced apart groups of spaced apart oval orifices, each orifice for receiving respective ones of the bars in the filing cabinet.

These and other objects and advantages of the present invention will be discussed in or apparent from the detailed description of the presently preferred embodiments of the invention.

BRIEF DESCRIPTION OF THE DRAWINGS

FIG. 7 is a partial side elevational view, partly in cross-section with parts removed, and taken along line 7—7 in FIG. 6.

FIG. 8 is a partial side elevational, cross-sectional view with parts removed of a second embodiment of the invention.

FIG. 9 is a side elevational view of an elongate strip according to the present invention which is attached to a document or sheet and which is used in combination with a filing cabinet of the present invention.

DESCRIPTION OF THE PREFERRED EMBODIMENTS

Figure 2:
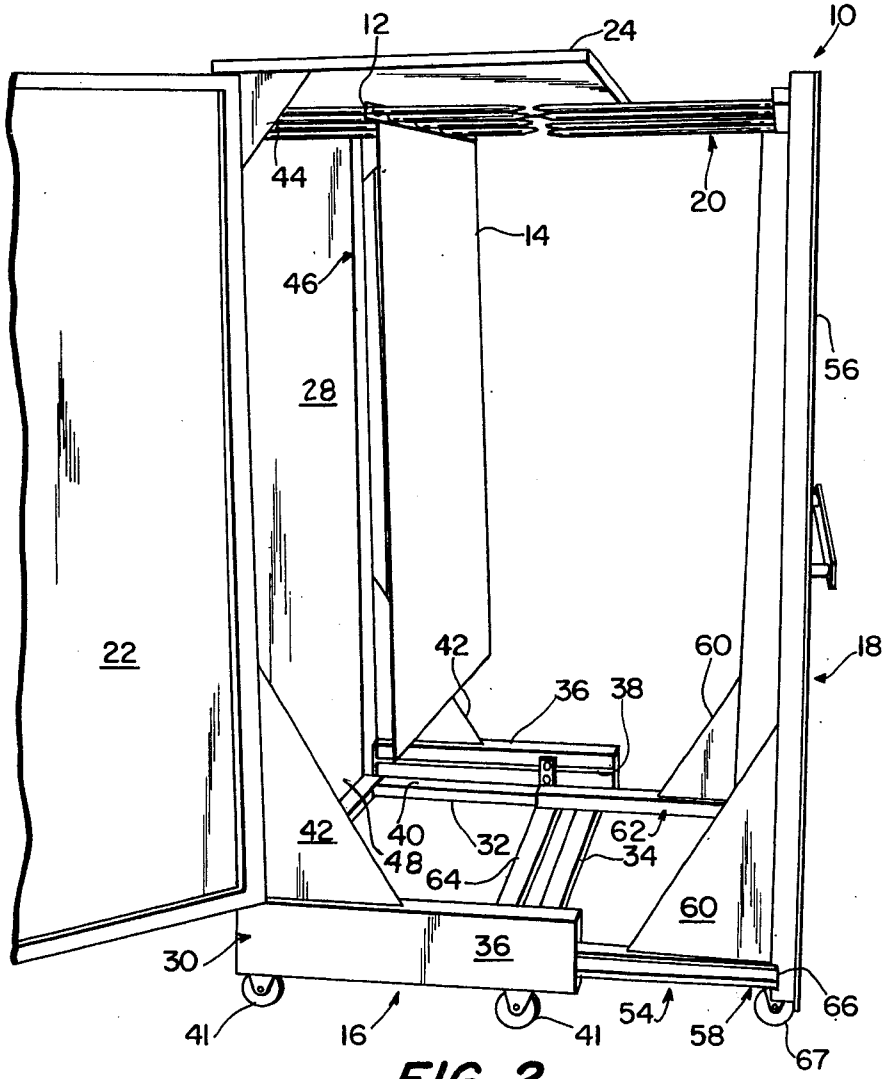
FIG. 2 is a perspective view of the filing cabinet depicted in FIG. 1 in the open position.

A filing system for vertically suspending sheets or documents is disclosed in the several views wherein like numerals represent like elements and comprises in combination a filing cabinet 10 and an elongate strip 12 that is attachable to a document 14 so that document 14 can be vertically suspended in filing cabinet 10. Filing cabinet 10 is comprised of a first or main frame or unit 16 and a removable second or pull-out frame or unit 18 that is slidably received by main frame 16. Means for suspending the documents comprises a plurality of cantilevered bars 20 rigidly mounted at the upper ends of main frame 16 and pull-out unit 18. Filing cabinet 10 also comprises hinged sides 22 and a hinged top 24.

With reference to FIGS. 1 through 6, main frame 16 comprises a horizontal base 26 and a vertical side 28 mounted at the bottom end thereof to the rearward end 30 of base 26. Base 26 comprises a welded U-shaped frame 32 made from square channels, a horizontal, transversely extending stabilizer bar 34 rigidly attached proximal the forward end of U-shaped frame 32, and a pair of longitudinally extending vertical sides 36 securely mounted to U-shaped frame 32. Two horizontal tracks 38 are rigidly mounted to the inward faces of base sides 36. A resilient molding 40, best seen in FIG. 8, extends along the inward surface of each arm of frame 32 for protecting main frame base 26 as pull-out unit 18 is moved relative thereto. As will be appreciated, a floor section could be included, supported by bar 34, or alternatively, bar 34 could be excluded and the lower frame 32 strengthened by providing corner gussets in a manner known per se.

Mounted on the bottom of main frame 16 at each corner thereof are four 4 inch swivel casters 41. A lower gusset plate 42 is rigidly attached, for example by welding, at each side of base 26 to both base 26 and vertical side 28 and provides rigidity and strength to main frame 16. As shown in FIG. 7, an upper gusset plate 44 is rigidly attached at the upper end along each edge of vertical side 28 and provides a mounting for top 24.

Vertical side 28 of main frame 16, as best shown in FIGS. 2 and 7, comprises a frame 46 preferably made from four welded, hollow channel bars, and a back 48, preferably comprised of sheet metal, rigidly attached, for example by welding, to frame 46. Mounted to the top of frame 46 is a smaller hollow square channel 50 to which a piano hinge 52 for mounting top 24 is attached.

Figure 5:
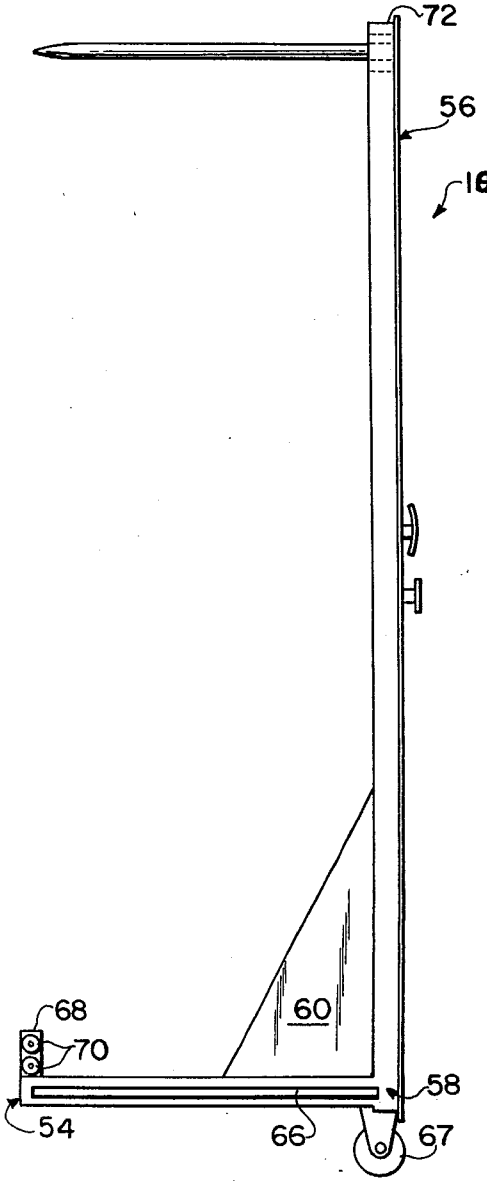
FIG. 5 is a side elevational view of the pull-out half of the filing cabinet.

As best shown in FIGS. 2 and 5, pull-out unit 18 comprises a horizontal base 54 and a vertical side 56 mounted at the bottom end thereof to the forward end 58 of base 54. Two gusset plates 60, welded between vertical side 56 and base 54 provide rigidity for vertical side 56. Base 54 comprises a U-shaped frame 62 preferably made from hollow square channels welded together and a transversely extending stabilizer bar 64. A resilient molding 66 is fixedly attached on the outward sides of base 54 for engagement with resilient molding 40 when pull-out unit 18 is moved relative to main frame 16. As indicated previously in reference to base 26, a floor section could be included supported by bar 64, or bar 64 excluded and other strengthening means substituted.

Adjustably mounted to base forward end 58 of pull-out unit 18 are two spaced apart 4 inch fixed casters 67. Rigidly mounted on each side of the rearward end of pull-out unit base 54 is an upstanding bearing mounting bracket 68. Two vertically spaced apart rollers 70 are rotatably mounted on bracket 68 for engagement on either side of track 38 on main frame 16. Thus, with rollers 70 engaging tracks 38, the forward end of pull-out unit 18 is slidably supported by base 26 of main frame 16.

Figure 1:
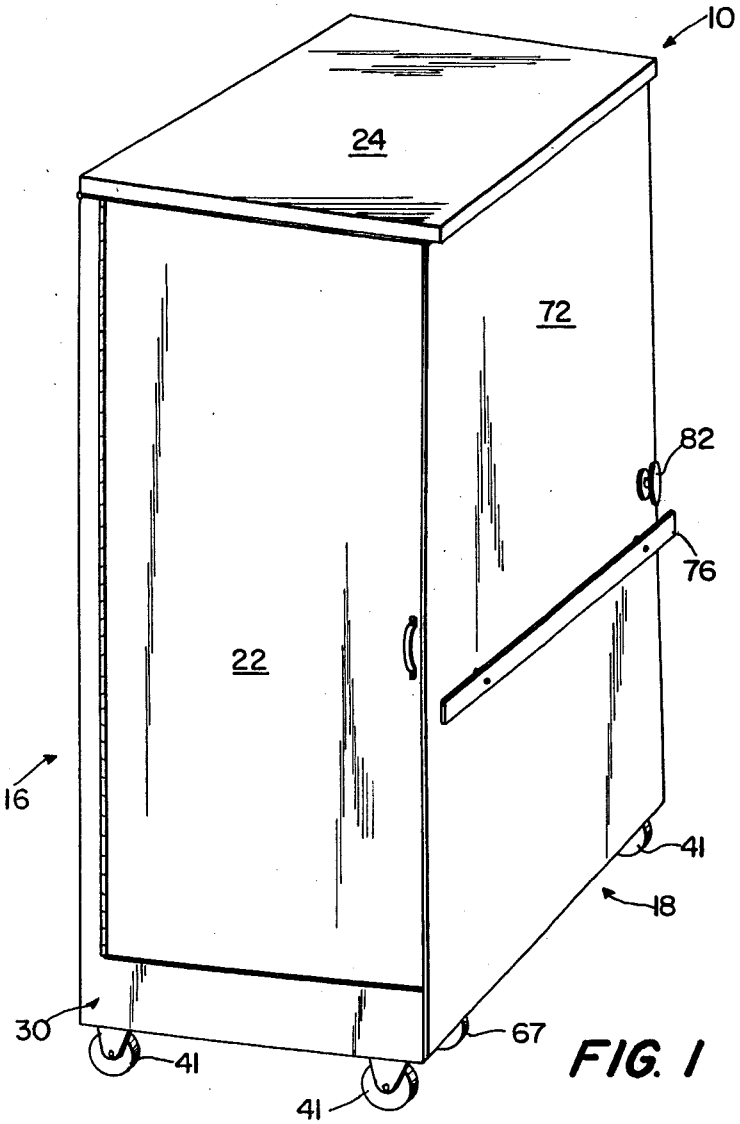
FIG. 1 is a perspective view of a filing cabinet in accordance with the present invention in the closed position.
Figure 6:
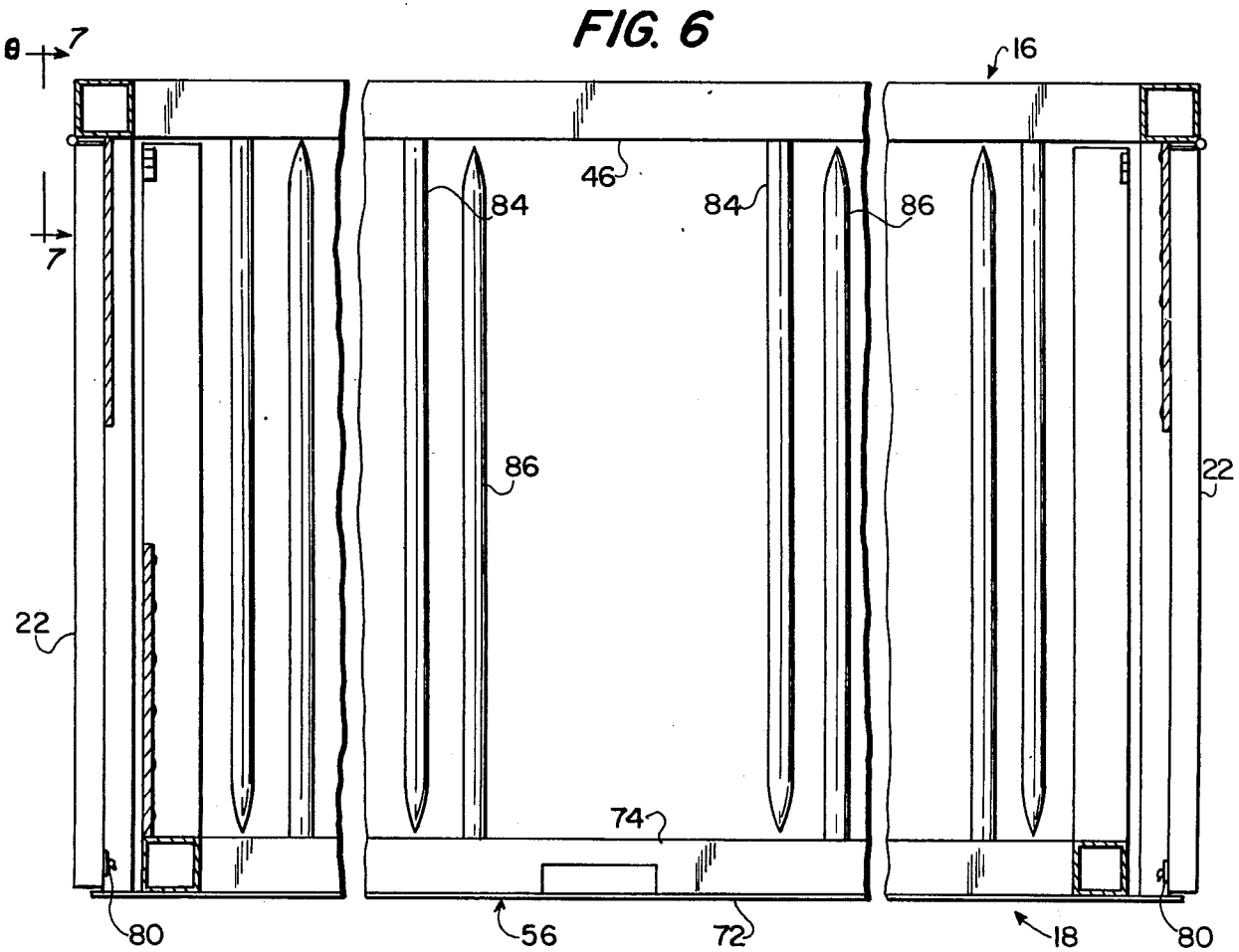
FIG. 6 is a plan view of the filing cabinet with the top removed.

As best seen in FIGS. 1 and 6, vertical side 56 of pull-out unit 18 is comprised of a sheet metal back 72 rigidly mounted, for example by being welded, onto a frame 74 of four hollow, square channel members. A transversely extending pull-out bar 76 is rigidly mounted on the outside or forward side of back 72 for providing a means for pulling out pull-out unit 18 and opening filing cabinet 10. A locking system permits the locking of file cabinet 10 in the closed position and comprises a conventional drop bolt 80 and operating handle 82 together with appropriate linking members (not shown).

Bars 20 from which documents 14 can be suspended comprise, in the preferred embodiment, three-quarter inch round, straight bars mounted at one end and having a rounded distal end, as shown in FIGS. 5, 6, and 7. In one embodiment of the invention, bars 20 are arranged into four laterally spaced apart groups with each group having first and second laterally spaced apart bars 84 and 86, respectively. The first bars 84 are rigidly mounted at the top end portion of main frame side 28, for example by weld 88 and spot welds 90 to frame 46. Second bars 86 are similarly rigidly mounted at the top end portion of pull-out unit side 56. First and second bars 84 and 86 are preferably mounted at the same vertical height on their corresponding vertical sides 22 and 56 so that they are substantially coplanar. It can thus be seen that first and second bars 84 and 86 conjointly suspend documents 14 at one end of the documents.

Elongate strip 12 is best seen in FIG. 9 as comprising a plurality of pairs of oval orifices 92. The number of pairs of orifices 92 and the spacing between the pairs, as well as the spacing of the orifices in each pair, is equal in number and spacing to bars 20. It is preferable that elongate strip 12 be manufactured from a suitable plastic material such as a thin thermoplastic polyester, for example "MYLAR" (a trademark of DuPont) and which consists essentially of polyethylene terephthalate. An elongate strip 12 made from the presently preferred "MYLAR" material is flexible, yet is resistant to tears and physical decomposition. Such a strip can be easily mounted along the bottom end thereof to the top portion of a document 14 with means such as an adhesive tape 94, with staples, or with other similar fastening means.

An alternative embodiment in which the rearward end of pull-out unit base 54 is telescopically, slidably mounted to main frame base 26 is depicted in FIG. 8. An upstanding bracket 96 is mounted to the sides of base frame 62 of pull-out unit 18. Rotatably mounted on bracket 96, for example with a bolt 98 and a nut 100, are two vertically spaced apart rollers, an upper roller 102 and a lower roller 104. Upper roller 102 engages along the top thereof an angle bracket 106 that is rigidly mounted for example by being welded to main frame base 26. Lower roller 104 engages along the bottom thereof a smaller hollow square channel 108 that is rigidly mounted on the top of the arms of frame 32 for example by being spot welded. The alternative embodiment for supporting the rearward end of pull-out unit 18 provides a greatly stiffened filing cabinet which can be easily opened and closed even when fully loaded.

Figure 4:
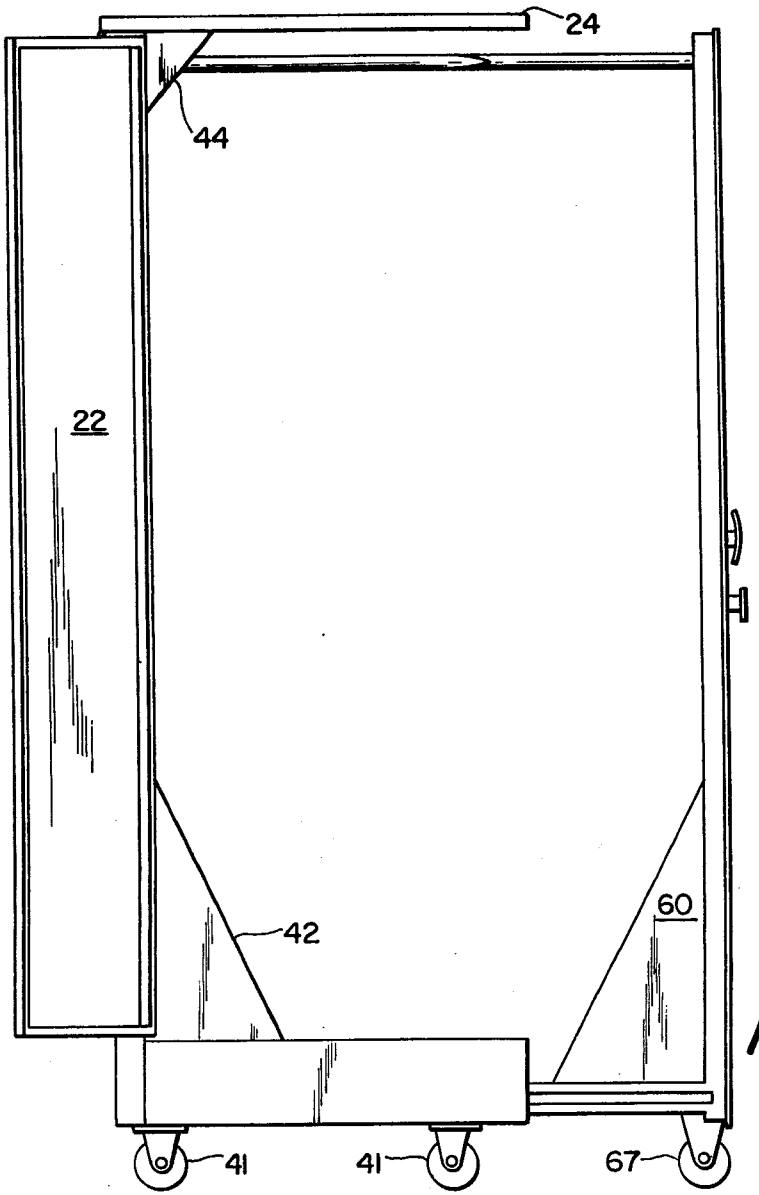
FIG. 4 is a side elevational view of the filing cabinet in an extended, partially opened position.
Figure 3:
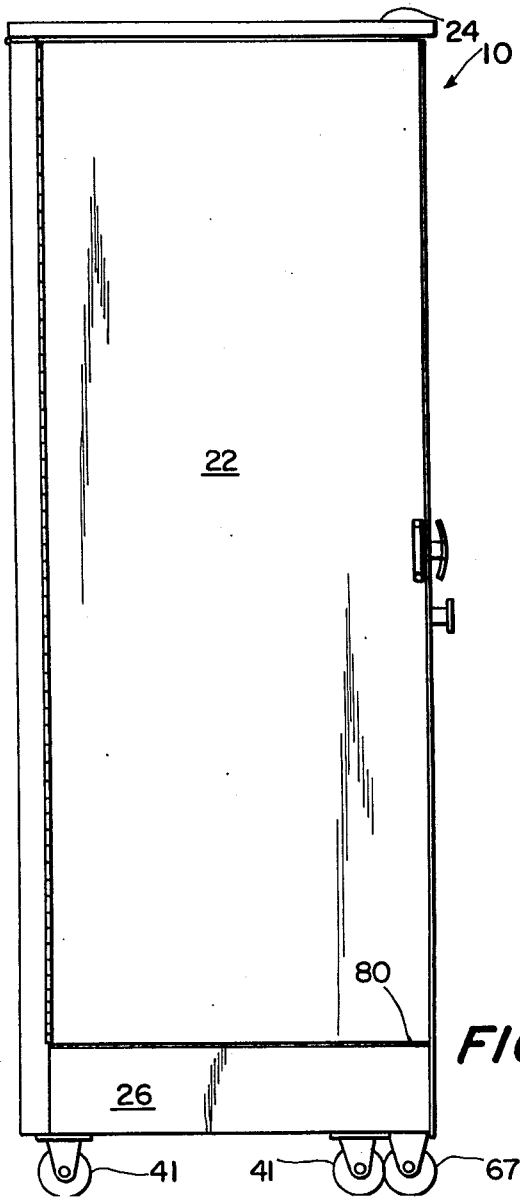
FIG. 3 is a side elevational view of the filing cabinet in the closed position.

The filing system of the present invention can be easily used to efficiently and safely suspend large numbers of documents. An elongate strip is securely fastened to the top portion of each document, the document preferably being centered between the ends of the strip. Alternatively, should it be necessary to file narrower drawings shorter, two hole strips could be utilized mounted in side-by-side relation across the width of the cabinet. The filing cabinet is then unlocked by rotating handle 82 and pullint out pull-out unit 18 using bar 76. Pull-out unit 18 is pulled out far enough so that there is a small space between the distal ends of first and second bars 84, as shown in FIG. 2. This space should however be large enough to facilitate filing and retrieval of drawings. Hinged sides 22 can be opened for easy access to the interior of filing cabinet 10 if filing cabinet 10 is of the large "walk-in" type or hinged top 24 can be opened in smaller models. Strip 12 is then suspended from either first bars 84 or second bars 86 and filing cabinet 10 can then be closed. Should it be desirable to only observe a suspended document without removing it from filing cabinet 10, pull-out unit 18 is only withdrawn an amount to ensure an overlap between first and second bars 84 and 86, as shown in FIG. 4. Even when filing cabinet 10 is fully loaded with documents, upwards of 3,000 thousand documents easily being storable in a larger filing cabinet, the documents can be readily separated as a result of the almost frictionless contact between the elongate strip 12 and bars 20 and because of the oval shape of orifices 92. Further in this regard, it is noted that when a filing cabinet is fully loaded, the weight of the documents tends to warp bars 20 and the sides of main frame 16 and pull-out unit 18. Whereas conventional round orifices and conventional suspension means would bind up, the oval orifices 92 can accommodate for the disalignment and warping of bars 20 and filing cabinet 10.

Although the invention has been described in detail with respect to exemplary embodiments thereof, it will be understood by those of ordinary skill in the art that variations and modifications may be effected within the scope and spirit of the invention.

What I claim is:

1. A filing cabinet for vertically suspending sheets wherein said filing cabinet is supported solely by a horizontal supporting surface such as a floor, said filing cabinet comprising:

a first frame having a first base supported by the supporting surface and a first vertical side mounted at the bottom end thereof to one end of said first base;

a second frame having a second base supported by the supporting surface and a second vertical side mounted at the bottom end thereof to one end of said second base;

means for telescopically engaging and supporting said second base by said first base such that said other end of said second base is cooperatively engaged with said other end of said first base and such that said first and second frames can be relatively separated to open said filing cabinet and can be relatively combined to close said filing cabinet, said engaging and supporting means comprising laterally spaced apart track members mounted on said first base and laterally spaced apart roller means mounted on said second base for correspondingly engaging said track members for movably supporting said other end of said second base;

means for movably supporting said cabinet on the supporting surface;

a single coplanar row of cantilever means for supporting the sheets, and comprising at least two, laterally spaced apart groups of substantially straight horizontally and longitudinally extending cantilevered bars, each said group of bars comprising at least first and second laterally spaced apart bars, said first ones of each group of bars being rigidly mounted to the top end portion of said first side and said second ones of each group of bars being rigidly mounted to the top end portion of said second side, said bars being for conjointly suspending the sheets at one end of the sheets; and sheet suspension means comprising a plurality of orifices for cooperating with said bars to suspend sheets therefrom.

2. A filing cabinet as claimed in claim 1 wherein said roller means comprises two pairs of vertically spaced, rotatably mounted rollers, one pair of rollers being mounted on each side of said second base, and wherein said track members each comprises parallel upper and lower longitudinally extending tracks rigidly mounted to said first base, the upper roller engaging the lower surface of the upper track and the lower roller engaging the upper surface of the lower track.

3. A filing cabinet as claimed in claim 1 wherein said cabinet supporting means comprises first rotatable roller means swivelably mounted to the bottom at both said one end and said other end of said first base and second rotatable roller means fixedly mounted to the bottom at said one end of said second base.

4. A filing cabinet as claimed in claim 1 wherein said sheet suspension means comprises an elongate, thin plastic strip having said orifices therein and means for attaching said strip along the bottom thereof to one end of the sheet.

5. A filing cabinet as claimed in claim 4 wherein said orifices are larger than said bars and are substantially oval in shape, the upper perimeter of each of which extends horizontally as a substantially straight edge so as to provide reduced-friction contact with said bars, and the major axis of which is substantially horizontal.

6. A filing cabinet as claimed in claim 5 wherein the lateral spacing between said first and second bars, and hence between corresponding said orifices, is relatively close with respect to the lateral spacing between said groups of bars, said orifices being located in groups corresponding to the grouping of said bars and being equal in number of the number of bars.

7. A filing cabinet as claimed in claim 1 and further including a moulding mounted on each inner side of said first base between said corresponding outer sides of said second base for protecting said first base as said second base is moved relative thereto.

8. A filing cabinet as claimed in claim 1 wherein the number of said plurality of orifices is equal to the number of said bars.

* * * * *